US007136025B2

(12) United States Patent
Lin et al.

(10) Patent No.: US 7,136,025 B2
(45) Date of Patent: Nov. 14, 2006

(54) DUAL-BAND ANTENNA WITH LOW PROFILE

(75) Inventors: Hsien-Chu Lin, Tu-Chen (TW); Chen-Ta Hung, Tu-Chen (TW); Lung-Sheng Tai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,263

(22) Filed: Nov. 30, 2004

(65) Prior Publication Data

US 2005/0243006 A1 Nov. 3, 2005

(30) Foreign Application Priority Data

Apr. 30, 2004 (TW) ..... 93112181 A

(51) Int. Cl.
*H01Q 13/10* (2006.01)
*H01Q 1/38* (2006.01)

(52) U.S. Cl. ..... 343/770; 343/700 MS

(58) Field of Classification Search ..... 343/770, 343/826–830, 700 MS
See application file for complete search history.

(56) References Cited

U.S. PATENT DOCUMENTS 3,577,196 A * 5/1971 Pereda ..... 343/770
4,489,328 A * 12/1984 Gears ..... 343/700 MS
5,298,907 A * 3/1994 Klein ..... 343/715
5,646,637 A * 7/1997 Miller ..... 343/713
6,091,366 A * 7/2000 Zhang et al. ..... 343/700 MS
6,121,930 A * 9/2000 Grangeat et al. .... 343/700 MS
6,211,825 B1 * 4/2001 Deng ..... 343/700 MS
6,677,909 B1 * 1/2004 Sun et al. ..... 343/767
6,703,983 B1 * 3/2004 Huang ..... 343/768
6,853,341 B1 * 2/2005 Hellgren et al. ..... 343/742
2004/0017319 A1 1/2004 Wang et al.
2004/0104849 A1 * 6/2004 Tai et al. ..... 343/700 MS
2004/0104853 A1 6/2004 Chen
2004/0257283 A1 * 12/2004 Asano et al. ..... 343/702

* cited by examiner

*Primary Examiner*—Don Wong
*Assistant Examiner*—Marie Antoinette Cabucos
(74) *Attorney, Agent, or Firm*—Wei Te Chung

(57) ABSTRACT

A dual-band antenna can be used in wireless communications under Bluetooth and IEEE 802.11a/b/g standards includes a rectangular base (1) forming a transverse bar (5) and a grounding bar (41) extending therefrom in a same direction, a radiating portion (2) arranged distantly above the base, an interconnection bar (3) connecting the base and the radiating portion and a feeder cable (6). The radiating portion includes a first and a second radiating arms extending from the interconnection bar in opposite directions. The first and the second radiating arms, the interconnection bar, the transverse bar, the grounding portion and the feeder cable corporately form a first and a second inverted-F antennas respectively operating at a lower frequency band and a higher frequency band.

22 Claims, 9 Drawing Sheets

DUAL-BAND ANTENNA WITH LOW PROFILE

BACKGROUND OF THE INVENTION

1. Field of the Invention

The present invention relates generally to an antenna, and more particularly to a multi-band antenna used in an electrical device.

2. Description of the Prior Art

In recent years, portable wireless communication devices are becoming increasingly popular. For the design of the wireless communication device, an antenna used with it for transmitting and receiving electromagnetic waves is an important factor should be taken into account. The antenna may be mounted out of or in the device. In general use, the antenna is built-in arranged to save space and increase convenience. Considering the miniaturization trend of the wireless communication devices, the size of the antenna should be accompanylingly reduced in order to be assembled in the limit space of the communication device.

Moreover, among present wireless technologies, Bluetooth running in 2.4 GHz, IEEE 802.11b/g running in 2.4 GHz and IEEE 802.11a running in 5 GHz are prevailing and dominant. In response to the wide applications of the frequency, there is an increasing demand to make one communication device to support two or more frequencies.

To make the miniaturized antenna supporting two or more working frequencies becomes a hot R&D issue. Many antennas have been developed in prior arts to address the issue, such as microstrip antennas, antennas with high dielectric constant, planar inverted-F antennas, combinations of loop antenna and slot antenna, small size patch antennas and the like.

U.S. Patent Application No. 2004/0017319 discloses a conventional multi-band planar inverted-F antenna with low profile and small size. The antenna is formed on a frame of a notebook computer. The antenna comprises a dielectric substrate, a first and a second radiating metal strips formed on a same surface of the substrate and extending in a same direction, and a ground plane. However, the dielectric substrate of the antenna will introduce insertion loss, which adversely affects the antenna gain.

Hence, in this art, a dual-band antenna with low profile and small size to overcome the above-mentioned disadvantages of the prior arts will be described in detail in the following embodiments.

BRIEF SUMMARY OF THE INVENTION

A primary object, therefore, of the present invention is to provide a dual-band antenna with compact size and wide bandwidth, for operating in wireless communications under Bluetooth, IEEE 80.211a/b/g standards, etc.

In order to implement the above object and overcomes the above-identified deficiencies in the prior art, the dual-band antenna comprises a rectangular base forming a transverse bar and a grounding bar extending therefrom in a same direction, a radiating portion arranged distantly above and parallel to the base, an interconnection bar connecting the base and the radiating portion and a feeder cable. The radiating portion comprises a first and a second radiating arms extending from the interconnection bar in opposite directions. The first and the second radiating arms, the interconnection bar, the transverse bar, the grounding portion and the feeder cable corporately form a first and a second inverted-F antennas respectively operating at a lower frequency band and a higher frequency band, which totally cover the prevailing wireless communication standards Bluetooth and IEEE 802.11a/b/g.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to preferred embodiments of the present invention.

Figure 1:
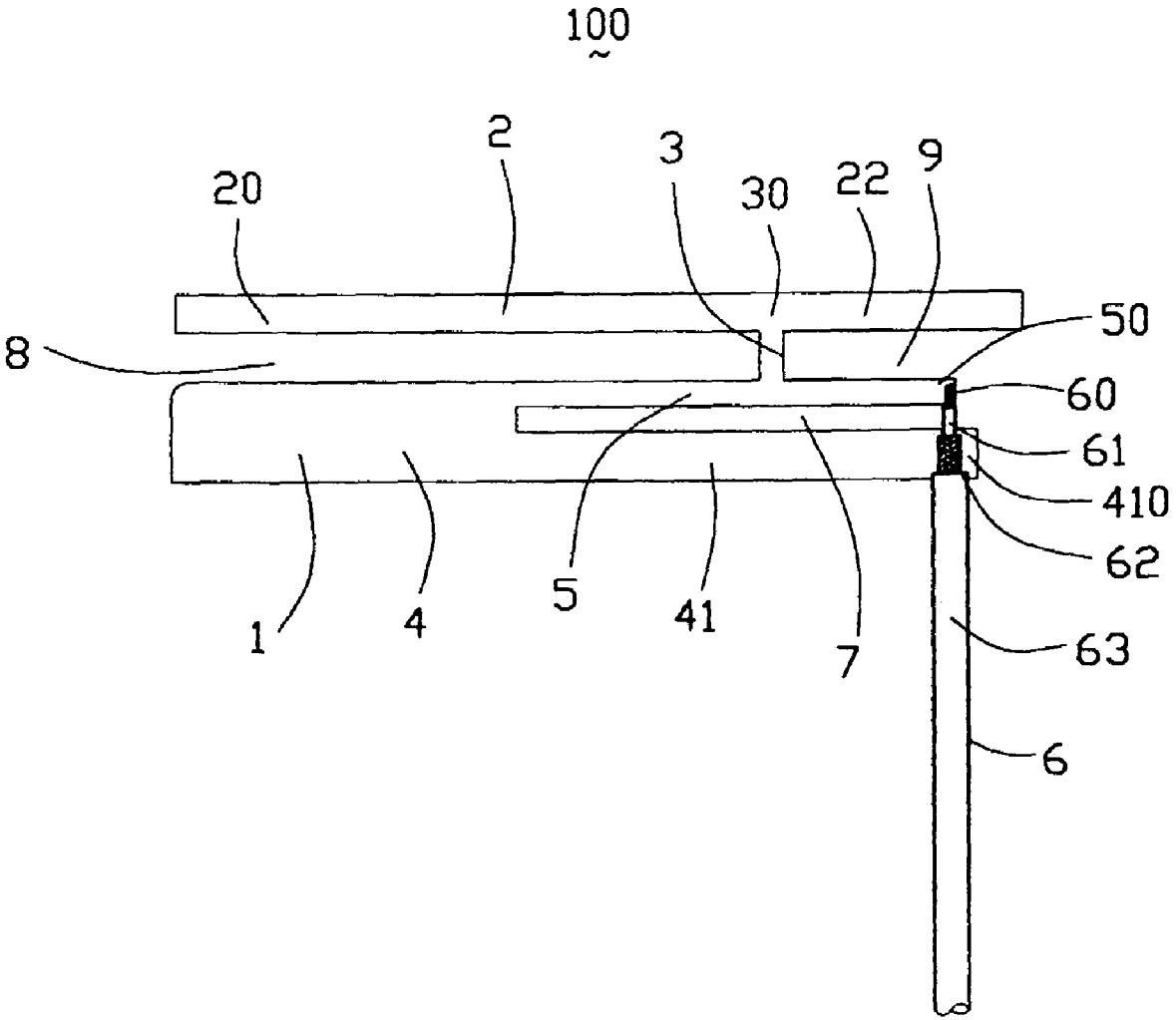
FIG. 1 is a front view of a dual-band antenna in accordance with a first embodiment of the present invention.

Referring to FIG. 1, a dual-band antenna 100 according to a first embodiment of the present invention is integrally made of a metal sheet and comprises a base 1, a radiating portion 2 distantly arranged above and parallel to the base 1, an interconnection bar 3 connecting the base 1 and the radiating portion 2 and a feeder cable 6.

The base 1 is substantially formed into a rectangular shape and comprises an extended grounding portion 4 and a transverse bar 5 functioning as a grounding portion. The transverse bar 5 has a free end 50 and an expanded end (not labeled) opposite to the free end. The grounding portion 4 extends enlargedly and downwardly from the lower longitudinal side of the expanded end toward the free end of the transverse bar 5. The grounding portion 4 forms a grounding bar 41 extending in a transverse direction. The transverse bar 5 is parallel to the grounding bar 41. The grounding bar 41 has a second distal end 410. The transverse bar 5 and the grounding bar 41 corporately define an interferential slot 7 with an open end facing to right.

The interconnection bar 3 perpendicularly and upwardly extends from the transverse bar 5 and terminates to the radiating portion 2.

The radiating portion 2 is strip-shaped and arranged in a same line, and comprises a first radiating arm 20 and a second radiating arm 22. The radiating portion 2 and the interconnection bar 3 are connected with one another at a conjunction 30. The first and the second radiating arms 20, 22 respectively extend from the conjunction 30 in opposite directions. The first and the second radiating arms 20, 22 respectively have a left free end and a right free end. The first radiating arm 20, the base 1 and the interconnection bar 3 corporately define a first elongated slot 8 with a first open end facing to left. The second radiating arm 22, the transverse bar 5 and the interconnection bar 3 corporately define a second elongated slot 9 with a second open end facing to right. The first and the second slots 8, 9 are arranged in a same line and parallel to the interferential slot 7. The interferential slot 7 is shorter than the first slot 8 and longer than the second slot 9. The open end of the second slot 9 and the open end of the interferential slot 7 are communicated with each other.

The feeder cable 6 is a coaxial cable and successively comprises an inner conductor 60, an inner insulator 61, an outer conductor 62 and an outer insulator 63. The inner conductor 60 is soldered on the free end 50 of the transverse bar 5. The outer conductor 62 is soldered on the distal end 410 of the grounding bar 41.

The first radiating arm 20, the interconnection bar 3, the transverse bar 5, the feeder cable 6 and the grounding portion 4 corporately form a first inverted-F antenna operating at a lower frequency band of about 2.4 GHz. The second radiating arm 22, the interconnection bar 3, the transverse bar 5, the feeder cable 6 and the grounding portion 4 corporately form a second inverted-F antenna operating at higher frequency bands of about 5.2 GHz and 5.75 GHz. Impedance matching of the first and the second inverted-F antennas can be adjusted by varying the length of the transverse bar 5. The transverse bar 5 can effectively increase the bandwidth of the first inverted-F antenna. Therefore, the transverse bar 5 is an important element for the impedance matching and the bandwidth of the antenna 100.

Figure 3:
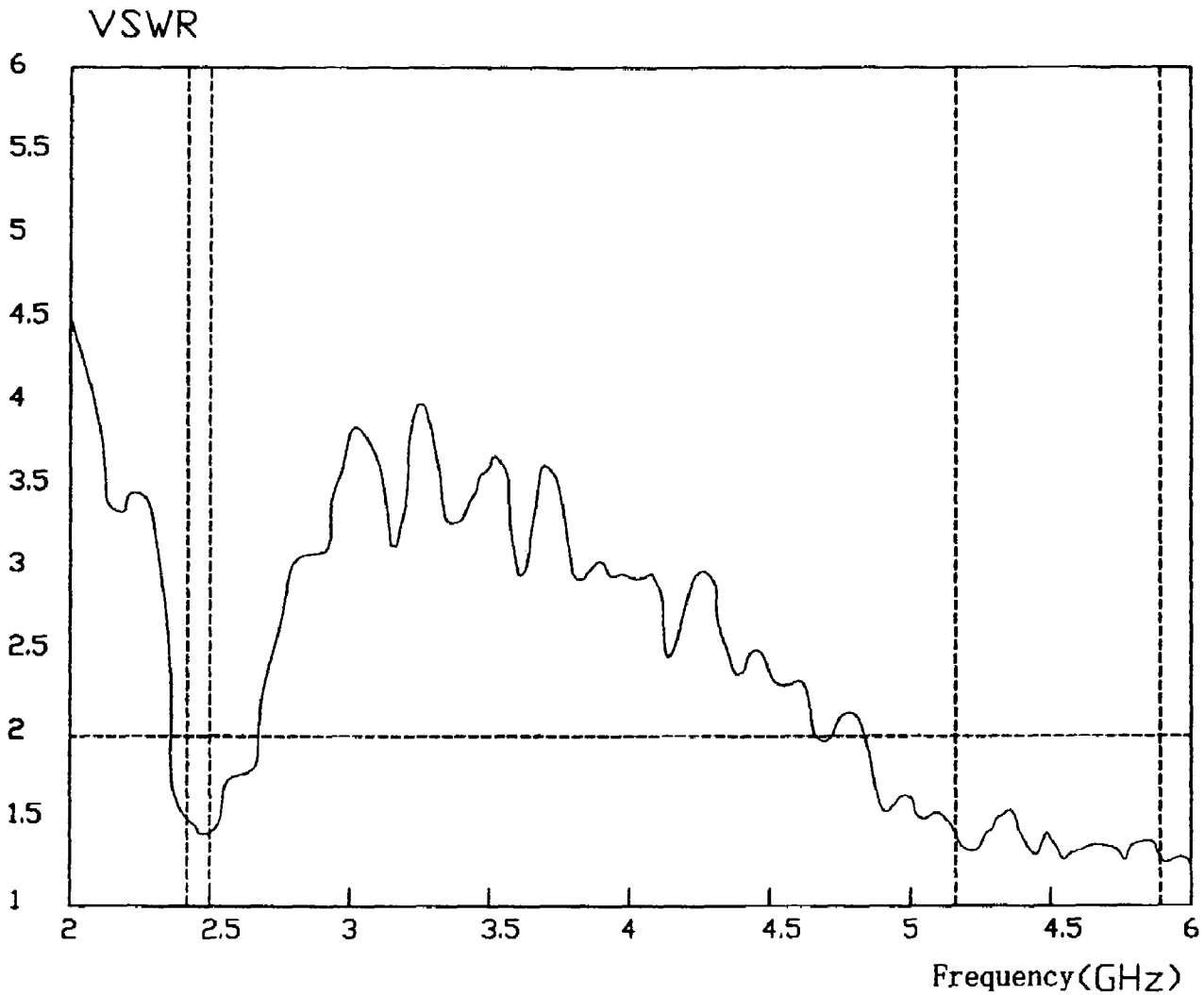
FIG. 3 is a test chart recording of Voltage Standing Wave Ratio (VSWR) of the dual-band antenna as a function of frequency.
Figure 4:
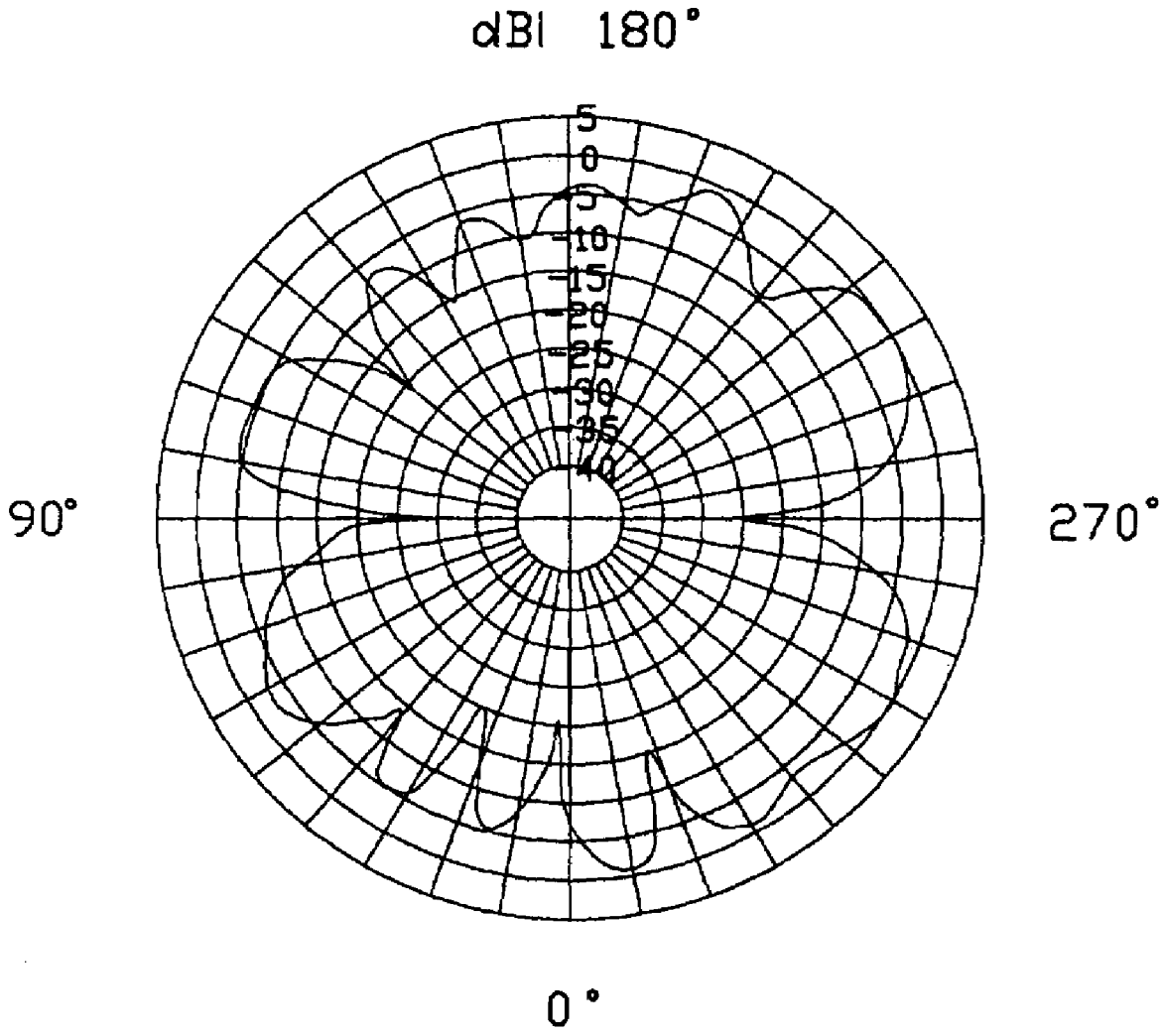
FIG. 4 is a horizontally polarized principle plane radiation pattern of the antenna operating at the resonant frequency of 2.45 GHz.
Figure 5:
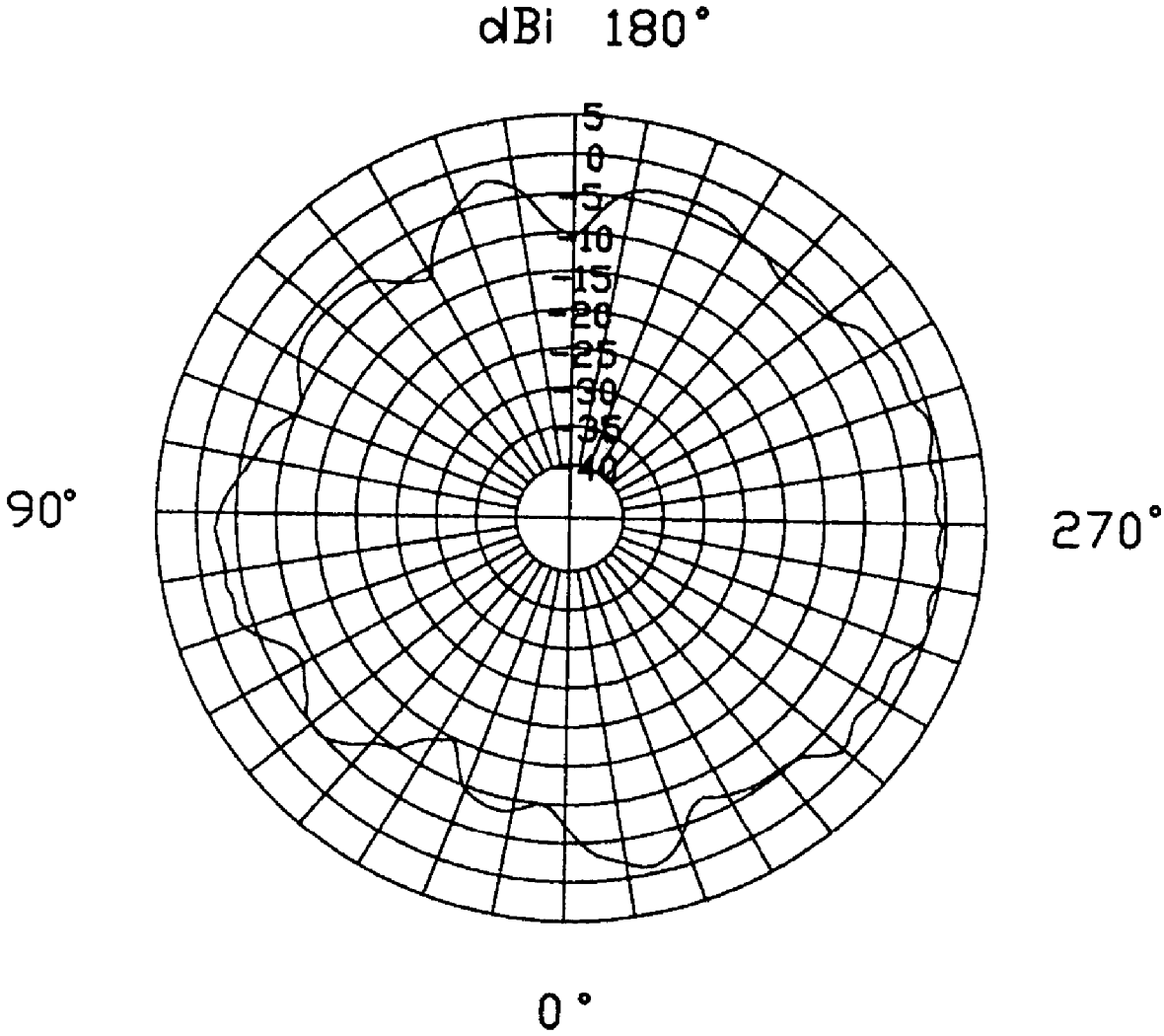
FIG. 5 is a vertically polarized principle plane radiation pattern of the antenna operating at the resonant frequency of 2.45 GHz.
Figure 6:
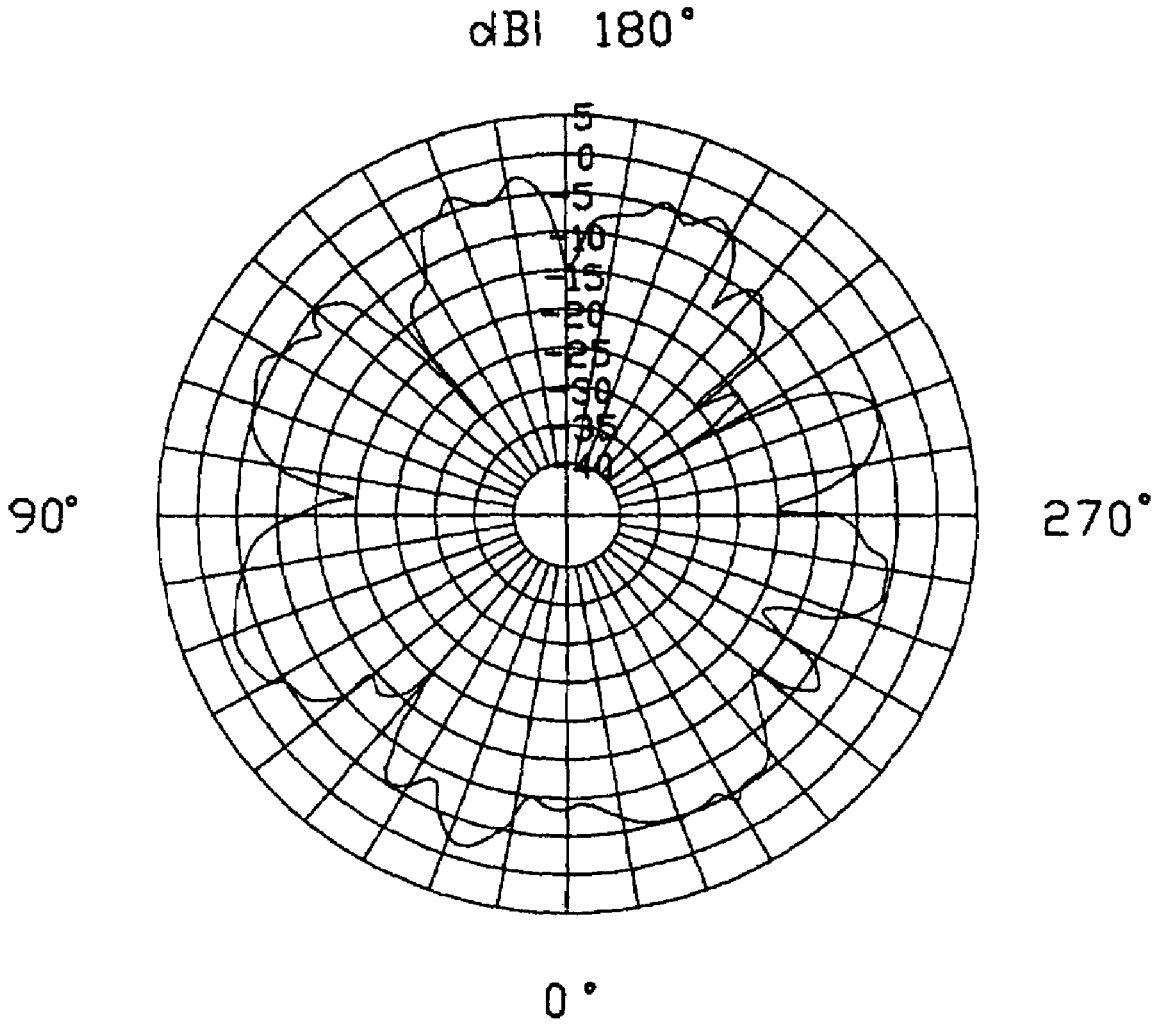
FIG. 6 is a horizontally polarized principle plane radiation pattern of the antenna operating at the resonant frequency of 5.25 GHz.
Figure 7:
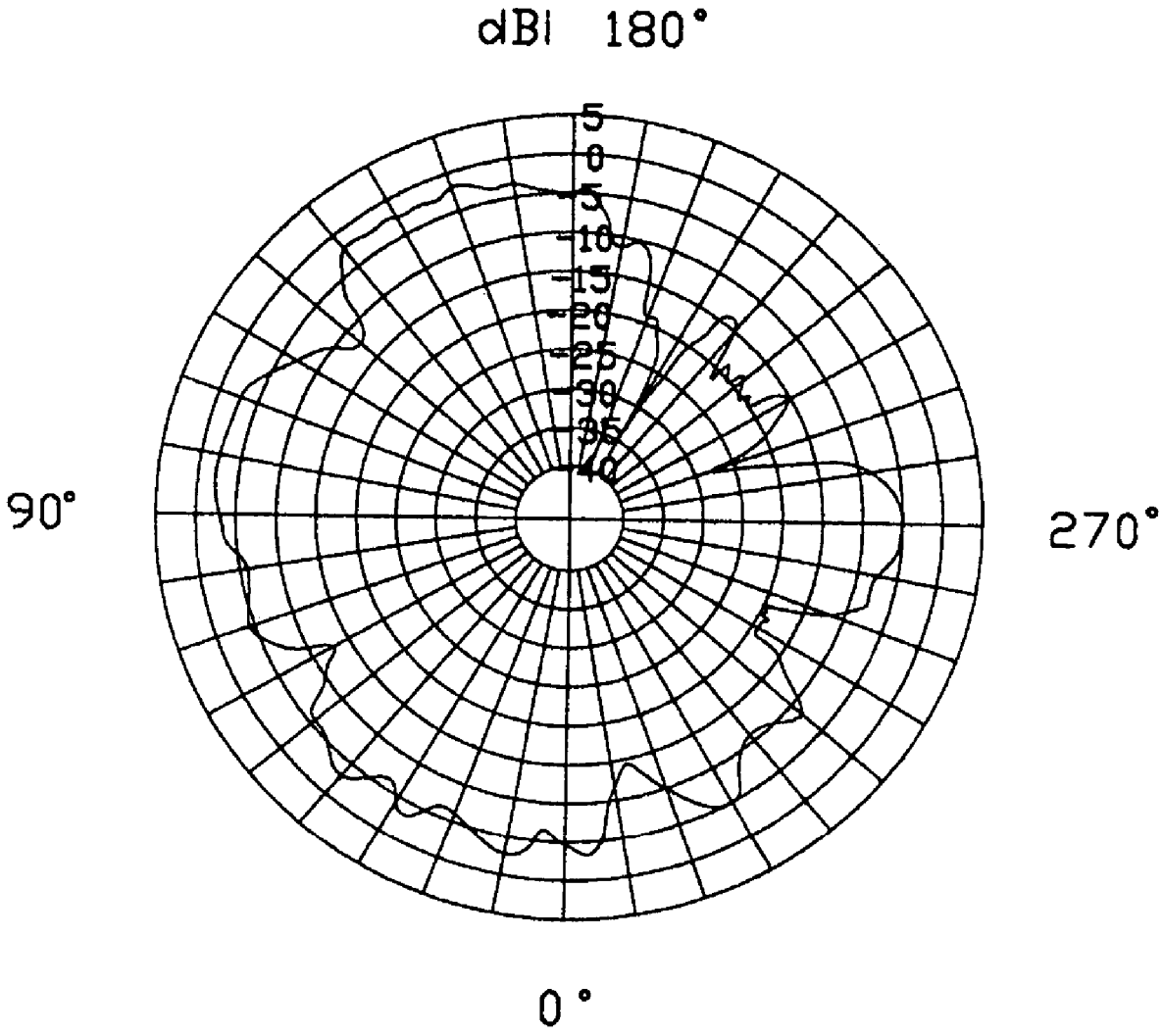
FIG. 7 is a vertically polarized principle plane radiation pattern of the antenna operating at the resonant frequency of 5.25 GHz.
Figure 8:
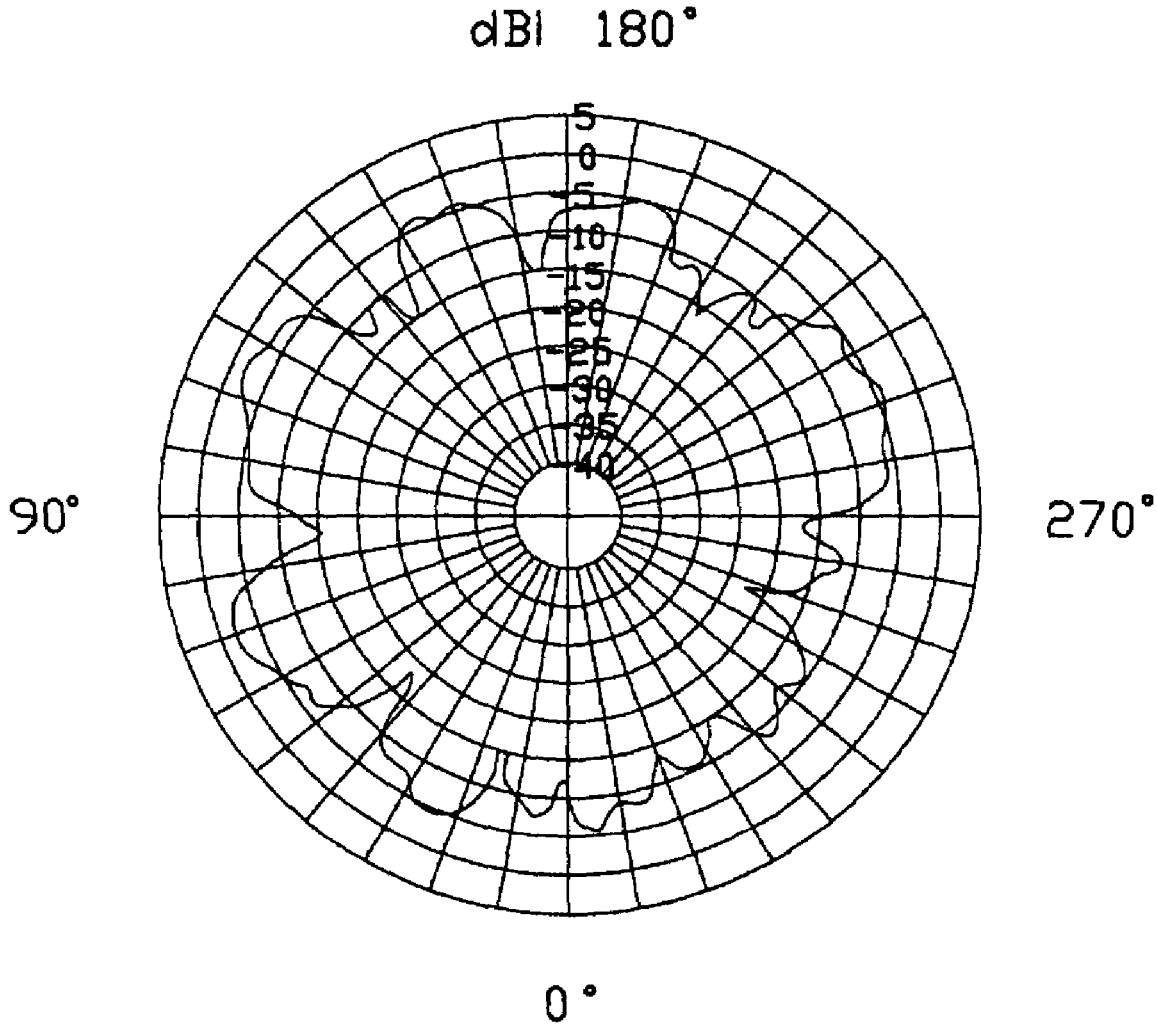
FIG. 8 is a horizontally polarized principle plane radiation pattern of the antenna operating at the resonant frequency of 5.598 GHz.
Figure 9:
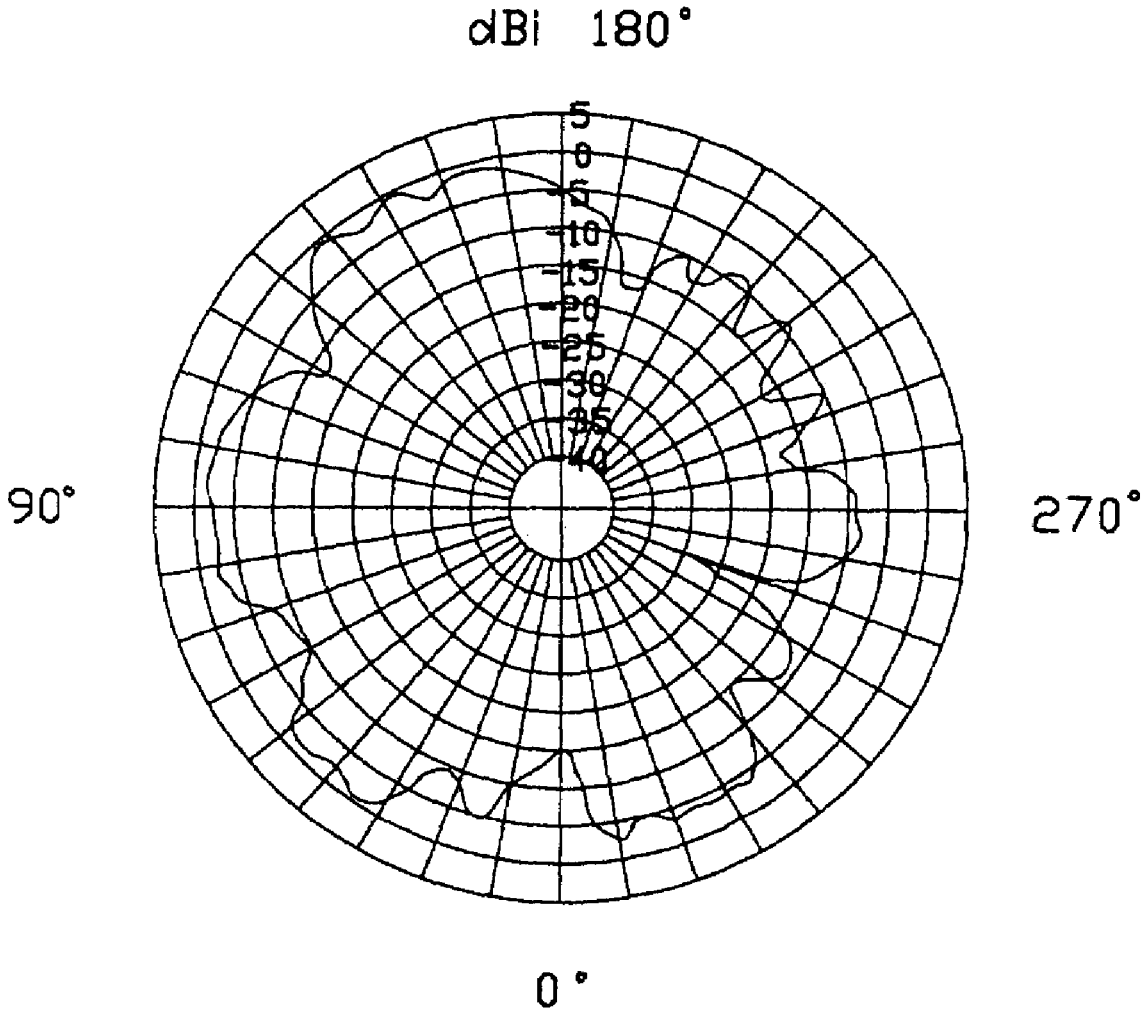
FIG. 9 is a vertically polarized principle plane radiation pattern of the antenna operating at the resonant frequency of 5.598 GHz.

In terms of this preferred embodiment, the performance of the antenna 1 is excellent. In order to illustrate the effectiveness of the present invention, FIG. 3 sets forth a test chart recording of Voltage Standing Wave Ratio (VSWR) of the dual-band antenna 100 as a function of frequency. Note that VSWR drops below the desirable maximum value "2" in the 2.4–2.5 GHz frequency band which covers the bandwidth of wireless communications under Bluetooth and IEEE 802.11b/g standard, and 5.15–5.85 GHz, indicating a wide bandwidth of 700 MHz, which covers the bandwidth of wireless communications under IEEE 802.11a standard.

FIGS. 4–9 show the horizontally polarized and vertically polarized principle plane radiation patterns of the antenna 1 operating at the resonant frequency of 2.45 GHz, 5.25 GHz and 5.598 GHz. Note that the each radiation pattern of the dual-band antenna 100 is close to corresponding optimal radiation pattern and there is no obvious radiating blind area, conforming to the practical use conditions of an antenna.

Figure 2:
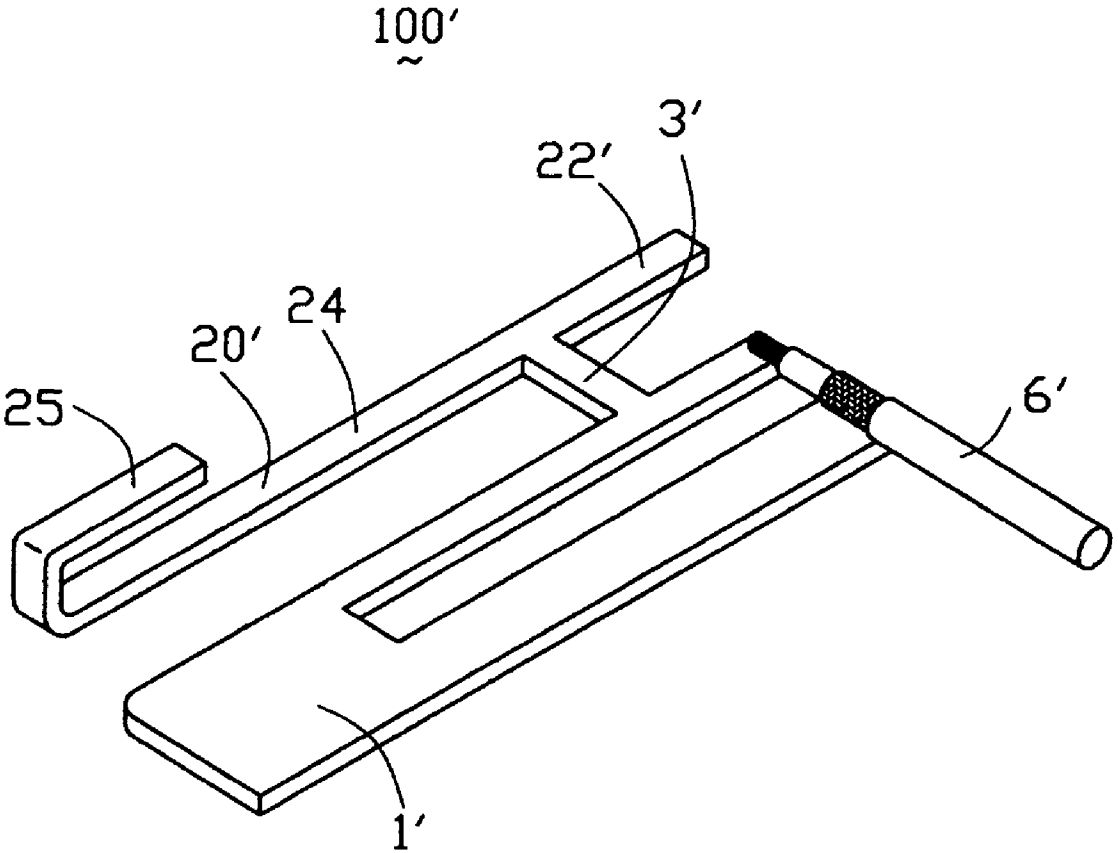
FIG. 2 is a perspective view of a second embodiment of the dual-band antenna in accordance with the present invention.

Referring to FIG. 2, a dual-band antenna 100' in accordance with a second embodiment of the present invention comprises a base 1' and an interconnection bar 3' respectively having the same configuration as the base 1 and the interconnection bar 3 in the first embodiment. The dual-band antenna 100' further comprises a radiating portion 2' having a first and a second radiating arms 20', 22' extending from the interconnection bar 3' in opposite directions. The first radiating arm 20' comprises a main arm 24 and an additive arm 25. The main arm 24 and the second radiating arm are arranged in a same line. The additive arm 25 is inverted-L shaped and extends upwardly then rightwardly from a left end of the main arm 24. The free ends of the first and the second radiating arm face to a same direction. The main arm 24 of the first radiating arm 20', the second radiating arm 22' and the base 1' are formed in a first plane. The additive arm 25 extends out of the first plane and is formed in a second plane. A feeder cable 6' is provided to feed the dual-band antenna 100'. The concrete configuration can refer to the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An integrated antenna used in an electronic device, comprising:

a metal sheet;

a first elongated slot defined in the metal sheet;

a second elongated slot defined in the metal sheet;

a third elongated slot defined in the metal sheet; and a feeder cable having an inner conductor and an outer conductor respectively electrically connected to two sides of the third slot;

wherein the first, the second and the third slots each have an open end communicating to air.

2. The integrated antenna as claimed in claim 1, wherein the second slot is communicated with the third slot, and the first slot is separated with the third slat.

3. The integrated antenna as claimed in claim 2, wherein the third slot is shorter than the first slot and longer than the second slot.

4. The integrated antenna as claimed in claim 1, wherein the metal sheet comprises a transverse bar separating the first and the third slots meanwhile separating the second and the third slots.

5. The integrated antenna as claimed in claim 4, wherein the metal sheet comprises an interconnection bar extending from the transverse bar and separating the first and the second slots, the first and the second slots being flush with one another in a transverse direction.

6. The integrated antenna as claimed in claim 5, wherein the first and the second slots are both parallel to the third slot.

7. The integrated antenna as claimed in claim 5, wherein the metal sheet comprises a first radiating arm and a second radiating arm both being disposed in a same line and extending from the interconnection bar in opposite directions.

8. The integrated antenna as claimed in claim 7, wherein the transverse bar has a free end away from the interconnection bar, the inner conductor of the feeder cable connected on the free end of the transverse bar.

9. A multi-band antenna, comprising:

a radiating portion comprising a first and a second radiating arms, the first and the second radiating arms each having a free end;

a grounding portion; and a transverse bar extending from the grounding portion and parallel to the radiating portion, the transverse bar having a free end;

wherein the first radiating arm, the second radiating arm and the transverse bar each have a free end.

10. The multi-band antenna as claimed in claim 9, wherein the multi-band antenna comprises an interconnection bar connecting the radiating portion and the transverse bar.

11. The multi-band antenna as claimed in claim 10, wherein the first radiating arm extends away from the interconnection bar in a first direction and the second radiating arm extends away from the interconnection bar in a second direction opposite to the first direction.

12. The multi-band antenna as claimed in claim 11, wherein the first radiating arm further comprises a bent section extending therefrom in the second direction.

13. The multi-band antenna as claimed in claim 10, wherein the radiating portion, the interconnection bar and the transverse bar form a substantially I-shaped configuration.

14. The multi-band antenna as claimed in claim 9, wherein the antenna further comprises a feeder cable, the first radiating arm, the transverse bar, the grounding portion and the feeder cable corporately Conning a first planar inverted-F antenna operating at a first frequency band, the second radiating arm, the transverse bar, the grounding portion and the feeder cable corporately forming a second planar inverted-F antenna operating at a second frequency band.

15. The multi-band antenna as claimed in claim 9, wherein the transverse bar and the first radiating arm are parallel to one another and corporately define a first slot therebetween, the transverse bar and the second radiating arm being parallel to one another and corporately defining a second slot therebetween, the first and the second slots being arranged in a same line.

16. A multi-band antenna, comprising:

a lying L-like grounding section;

a lying H-like portion including an upper radiation section, a middle interconnection section and a lower transverse section connected to an upper end of the grounding section via said lower transverse section; and a feeder cable crossing said grounding section and said transverse section with an inner conductor thereof mechanically and electrically connected to the transverse section and with an outer conductor thereof mechanically and electrically connected to the grounding section.

17. The antenna as claimed in claim 16, wherein said feeder cable is located at one lengthwise end of the combined lying L-like grounding section and lying H-like portion.

18. A multi-band antenna, comprising:

a radiating portion comprising a first radiating arm and a second radiating arm;

a base offset from said radiating portion and defining an interferential slot with one end open to an exterior;

an interconnection bar connecting the base to the radiating portion at a common point between the first and the second radiating arms; and a feeder cable having an inner conductor and an outer conductor respectively electrically connected to opposite sides of said interferential slot.

19. The multi-band antenna as claimed in claim 18, wherein said first radiating arm and said second radiating arm extend in a longitudinal direction.

20. The multi-band antenna as claimed in claim 18, wherein said first radiating arm comprises a main arm and an additive arm extending from said main arm, said main arm and said second radiating arm extending in a longitudinal direction.

21. The multi-band antenna as claimed in claim 18, wherein said base forms a grounding portion and a transverse bar via said interferential slot, said interconnection bar connected to said transverse bar.

22. A multi-band antenna, comprising:

a radiating portion comprising a first radiating arm and a second radiating arm;

a plate-shaped grounding base spaced from said radiating portion and comprising a first grounding portion having an expanded end and an extended second grounding portion enlargedly extending from one longitudinal side of said expanded end toward the other end of said first grounding portion, an interferential slot being formed between said first and said second grounding portions;

an interconnection bar connecting said radiating portion and said first grounding portion; and a feeder cable for providing power to said antenna.

* * * * *